US007213652B2

(12) United States Patent
Hepburn et al.

(10) Patent No.: US 7,213,652 B2
(45) Date of Patent: May 8, 2007

(54) SEALED BRANCH WELLBORE TRANSITION JOINT

(75) Inventors: Neil Hepburn, Edmonton (CA); Steven R. Fipke, Sherwood Park (CA)

(73) Assignee: Halliburton Energy Services, Inc., Houston, TX (US)

( * ) Notice: Subject to any disclaimer, the term of this patent is extended or adjusted under 35 U.S.C. 154(b) by 168 days.

(21) Appl. No.: 10/767,656

(22) Filed: Jan. 29, 2004

(65) Prior Publication Data

US 2005/0167109 A1 Aug. 4, 2005

(51) Int. Cl.
*E21B 43/00* (2006.01)

(52) U.S. Cl. ..... 166/313; 166/50

(58) Field of Classification Search ..... 166/277, 166/313, 50, 242.1, 242.5, 300
See application file for complete search history.

(56) References Cited

U.S. PATENT DOCUMENTS

| | | | | |
|---|---|---|---|---|
| 5,318,122 | A | 6/1994 | Murray et al. | |
| 5,338,648 | A * | 8/1994 | Kojima et al. | 430/393 |
| 5,340,160 | A * | 8/1994 | Meijers et al. | 285/15 |
| 5,458,209 | A | 10/1995 | Hayes et al. | |
| 5,615,740 | A | 4/1997 | Comeau et al. | |
| 6,070,671 | A | 6/2000 | Cumming et al. | |
| 6,089,320 | A | 7/2000 | LaGrange | |
| 6,092,602 | A * | 7/2000 | Gano | 166/313 |
| 6,241,021 | B1 | 6/2001 | Bowling | |
| 6,561,279 | B2 | 5/2003 | MacKenzie et al. | |
| 6,578,630 | B2 | 6/2003 | Simpson et al. | |
| 6,619,400 | B2 | 9/2003 | Brunet | |
| 6,883,611 | B2 * | 4/2005 | Smith et al. | 166/313 |
| 6,994,118 | B2 * | 2/2006 | Kiest et al. | 138/98 |
| 2001/0045284 | A1 | 11/2001 | Simpson et al. | |
| 2002/0157826 | A1 * | 10/2002 | MacKenzie et al. | 166/277 |
| 2003/0173092 | A1 | 9/2003 | Wilson et al. | |
| 2003/0192717 | A1 * | 10/2003 | Smith et al. | 175/61 |
| 2004/0194971 | A1 * | 10/2004 | Thomson | 166/387 |

FOREIGN PATENT DOCUMENTS

| | | | |
|---|---|---|---|
| FR | 2692316 | | 12/1993 |
| GB | 2304764 | A | 3/1997 |
| GB | 2353811 | A | 3/2001 |
| GB | 2371579 | A | 7/2002 |
| GB | 2388136 | | 11/2003 |
| WO | WO 02/20941 | | 3/2002 |
| WO | WO 02/059452 | * | 8/2002 |
| WO | WO 03/008756 | | 1/2003 |

OTHER PUBLICATIONS

U.S. Appl. No. 10/103,381, filed Mar. 21, 2002.

(Continued)

*Primary Examiner*—William Neuder
*Assistant Examiner*—Nicole Coy
(74) *Attorney, Agent, or Firm*—Marlin R. Smith

(57) ABSTRACT

A sealed branch wellbore transition joint. In a described embodiment, a completion system for a well having a branch wellbore extending outwardly from a window in a parent wellbore includes a tubular string having a portion positioned within the window, and a sealing material on the tubular string portion. The sealing material swells in the well to thereby form a seal between the tubular string portion and the window.

40 Claims, 4 Drawing Sheets

OTHER PUBLICATIONS

U.S. Appl. No. 10/103,025, filed Mar. 21, 2002.
Search Report for U.K. Application No. 0308428.2.
"HOMCO Internal Steel Liner Casing Patch", Weatherford Fishing and Rental Tool Services, dated 1995.
Sperry-Sun Multilateral Services Profile, "LRS-SL™ Self-Locating Lateral Re-entry System", dated 2000.
Sperry-Sun Multilateral Services Profile, "LRW-SL™ Self-Locating Lateral Re-entry Whipstock", dated 2000.
Sperry-Sun Multilateral Services Profile, "LRS™ Lateral Re-entry System", dated 2000.
Sperry-Sun Multilateral Services Profile, "WREAL™ Wireline Re-entry Alignment System", dated 2000.
Sperry-Sun Multilateral Services Profile, "TEW™ Tubing Exit Whipstock", dated 2000.
Sperry-Sun Multilateral Services Profile, "LRW™ Lateral Re-entry Whipstock", dated 2000.
Sperry-Sun Multilateral Services Profile, "TPI™ Through-Tubing Pressure Isolation Sleeve", dated 2000.
Sperry-Sun Multilateral Services Profile, "Vector Block", dated 2000.
Sperry-Sun Multilateral Services Profile, "RDS™ Re-entry Drilling System", dated 2000.
Sperry-Sun Multilateral Services Profile, "MERLIN™ Milled Exit Retrievable Multilateral System", dated 2000.
Sperry-Sun Multilateral Services Profile, "4502/4503™ Metal Mill-Through Systems", dated 2000.
Sperry-Sun Multilateral Services Profile, "RMLS™ Retrievable Multilateral System", dated 2000.
Sperry-Sun Multilateral Services Profile, "LTBS™ Lateral Tie-Back System", dated 2000.
Sperry-Sun Multilateral Services Profile, "PACE-6™ Pressure-Acutated Casing Exit System", dated 2000.
Sperry-Sun Multilateral Services Profile, "Sperry-Sun Latch Coupling", dated 2000.
Sperry-Sun Multilateral Services Profile, "4501™ Low-Side Perforation System", dated 2000.
Sperry-Sun Multilateral Services Profile, "MSCS® Multi-String Completion System", dated 2000.
Sperry-Sun Multilateral Services Profile, "ITBS™ Isolated Tie-Back System", dated 2000.
Sperry-Sun "Multilateral Products, Services, and Solutions", dated 2000.
Multilateral Technology "MACH-3™ Mechanical Anchored Casing Hanger Level 3 Multilateral System", dated 2003.
Easy Well Solutions, "Swell Packer Datasheet", dated 2003.
IADC/SPE 74496, "A New TAML Level 3 Multilateral System Improves Capabilities and Operational Efficiencies", dated 2002.
Search Report for U.K. application GB0501821.3.

* cited by examiner

SEALED BRANCH WELLBORE TRANSITION JOINT

BACKGROUND

The present invention relates generally to operations performed and equipment utilized in conjunction with a subterranean well and, in an embodiment described herein, more particularly provides a sealed branch wellbore transition joint.

A transition joint is used in completing some multilateral wells, for example, in TAML "Level 3" multilateral completions. As the name implies, the transition joint provides a useful transition between a parent wellbore and a branch wellbore drilled outwardly from the parent wellbore.

Unfortunately, it is a difficult problem to seal off a formation surrounding the intersection between the parent and branch wellbores from the parent wellbore. Where a sufficient seal is not provided, formation fines and sand can make their way into the parent wellbore, where they can plug or erode production equipment and cause other problems.

Therefore, it may be seen that it would be beneficial to provide improved well completion systems and methods. Such systems and methods could include an improved sealed branch wellbore transition joint.

SUMMARY

In carrying out the principles of the present invention, in accordance with an embodiment thereof, a sealed branch wellbore transition joint is provided for use in well completion systems and methods. A swelling sealing material is preferably used on the transition joint in order to seal off a formation surrounding an intersection between parent and branch wellbores.

In one aspect of the invention, a method of completing a well having a branch wellbore extending outwardly from a window in a parent wellbore is provided. The method includes the steps of: positioning an assembly in the window; and swelling a sealing material on the assembly. A seal is formed between the assembly and the window by the swelling sealing material.

In another aspect of the invention, a completion system for a well having a branch wellbore extending outwardly from a window in a parent wellbore is provided. The system includes a tubular string having a portion positioned within the window, and a sealing material on the tubular string portion. The sealing material swells in the well to thereby form a seal between the tubular string portion and the window.

In yet another aspect of the invention, a completion system for a well having a branch wellbore extending outwardly from a window in a parent wellbore includes an assembly positioned in the parent wellbore, the assembly having an opening formed through a sidewall thereof. The opening is aligned with the window. A sealing material is positioned on the assembly. The sealing material swells in the well to thereby form a seal circumferentially about the opening.

In a further aspect of the invention, a method of completing a well having a branch wellbore extending outwardly from a window in a parent wellbore includes the steps of: positioning an assembly in the parent wellbore; forming an opening through a sidewall of the assembly; aligning the assembly with the window; and swelling a sealing material on the assembly, so that a seal is formed about the opening.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
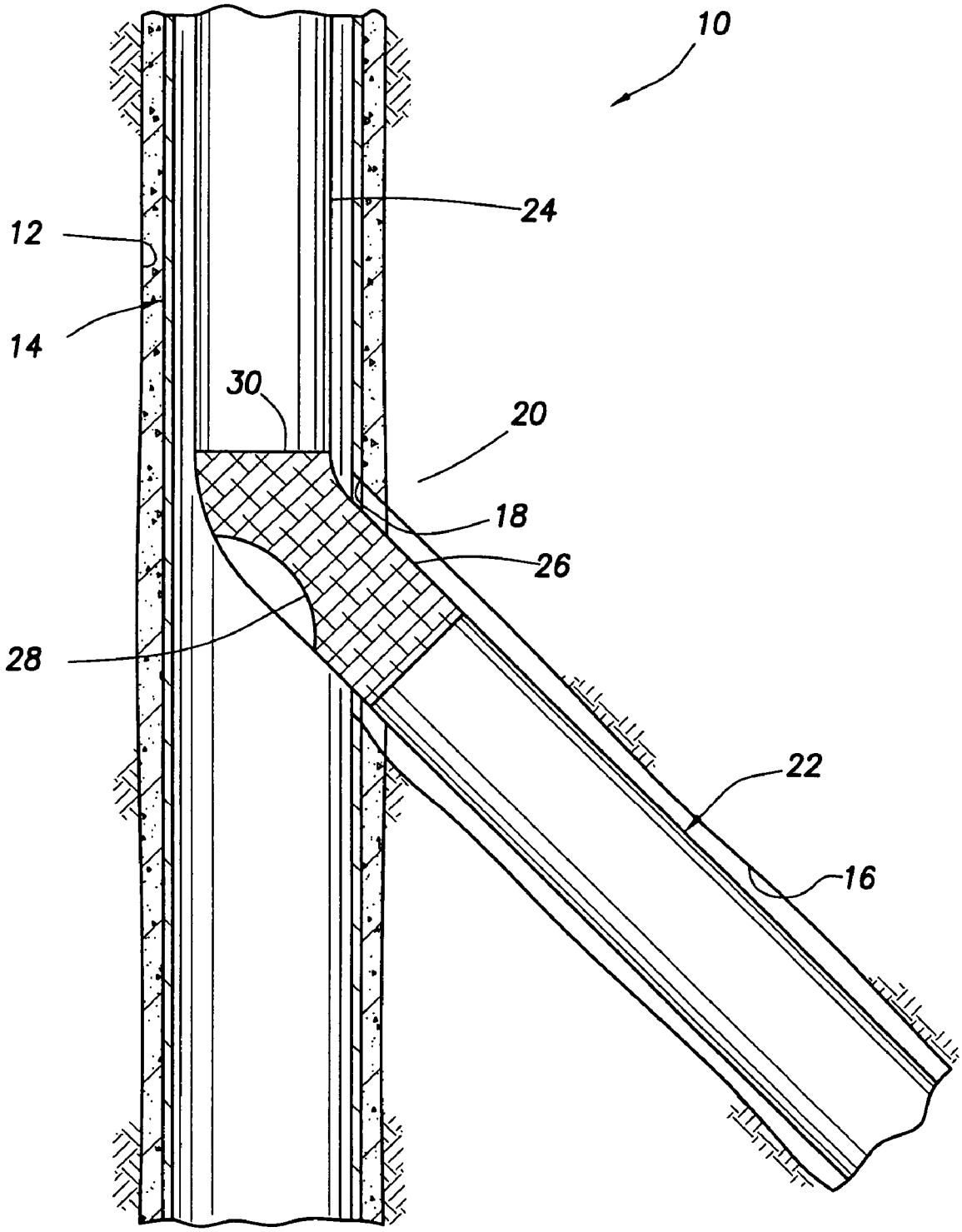
FIG. 1 is a schematic partially cross-sectional view of a first well completion system embodying principles of the present invention.

Representatively illustrated in FIG. 1 is a well completion system 10 which embodies principles of the present invention. In the following description of the system 10 and other apparatus and methods described herein, directional terms, such as "above", "below", "upper", "lower", etc., are used for convenience in referring to the accompanying drawings. In particular, the term "above" means relatively closer to the earth's surface along a wellbore, and the term "below" means relatively farther from the earth's surface along a wellbore. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a main or parent wellbore 12 has been drilled, and then lined with protective casing 14. The parent wellbore 12 may extend continuously to the earth's surface, or it may be a branch of another wellbore. It is not necessary in keeping with the principles of the invention for the parent wellbore 12 to be cased, since it could be completed open hole if desired. If the parent wellbore 12 is cased, then the wellbore can be considered the interior of the casing 14.

A branch wellbore 16 is drilled extending outwardly from a window 18 formed through a sidewall of the casing 14. The window 18 can be formed before or after the casing 14 is installed in the parent wellbore 12. For example, the window 18 could be formed by anchoring a whipstock (not shown) in the casing 14, and then deflecting a mill laterally off of the whipstock to cut the window through the casing sidewall.

A formation or zone 20 surrounds the intersection between the parent and branch wellbores 12, 16. In order to seal off the formation 20 from the interior of the parent wellbore 12, while also providing a useful transition between the parent and branch wellbores 12, 16, an assembly 22 is positioned in the window 18. The assembly 22 is depicted in FIG. 1 as including a tubular string 24 having a transition joint 26 interconnected therein.

A lower end of the tubular string 24 is deflected into the branch wellbore 16, for example, by using a whipstock or other deflector positioned in the parent wellbore 12. The tubular string 24 could be cemented in the branch wellbore 16, if desired.

The transition joint 26 has an opening 28 formed through a sidewall thereof. The opening 28 may be formed in the sidewall of the transition joint 26 before or after the transition joint is installed in the well. The opening 28 provides fluid communication (and preferably access) between an interior of the tubular string 24 and the parent wellbore 12 external to the tubular string below the window 18.

A sealing material 30 is provided on the transition joint 26. Preferably, the sealing material 30 is provided in the form of a coating adhered externally to the transition joint 26. However, other methods of attaching the sealing material 30 to the transition joint 26 may be used in keeping with the principles of the invention.

The sealing material 30 swells when exposed to fluid in the well. Preferably, the sealing material 30 increases in volume and expands radially outward when a particular fluid contacts the sealing material in the well. For example, the sealing material 30 could swell in response to exposure to hydrocarbon fluid (such as oil or gas), or in response to exposure to water in the well. The sealing material 30 could be made of a rubber compound, or it could be made of other materials.

Figure 2:
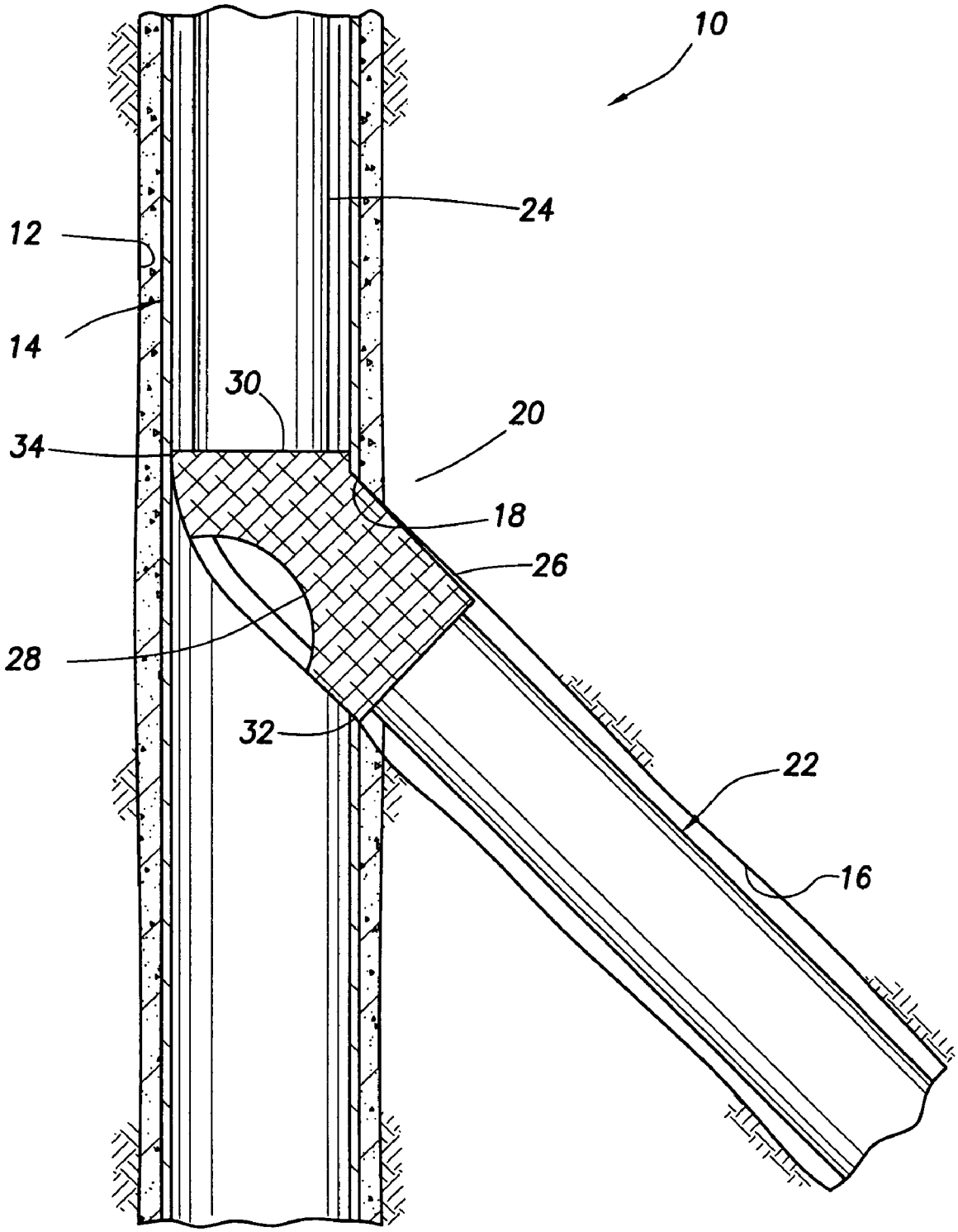
FIG. 2 is a schematic partially cross-sectional view of the first system, wherein a branch wellbore transition joint has been sealed.

Referring additionally now to FIG. 2, the system 10 is depicted after the sealing material 30 has swollen in the window 18. Note that a seal 32 is now formed by the swollen sealing material 30 between the transition joint 26 and the window 18. This seal 32 may be used to prevent fines, sand, etc. from migrating from the formation 20 into the parent wellbore 12. The tubular string 24 could be cemented in the branch wellbore 16 before or after the seal 32 is formed.

In addition, the swollen sealing material 30 can (but does not necessarily) provide another seal 34 between the transition joint 26 and the casing 14 in the parent wellbore 12. This seal 34 can be used as an annular barrier above the opening 28. Note that the opening 28 is conveniently positioned between the seals 32, 34 for providing fluid communication between the interior of the tubular string 24 and the parent wellbore 12 below the window 18.

Figure 3:
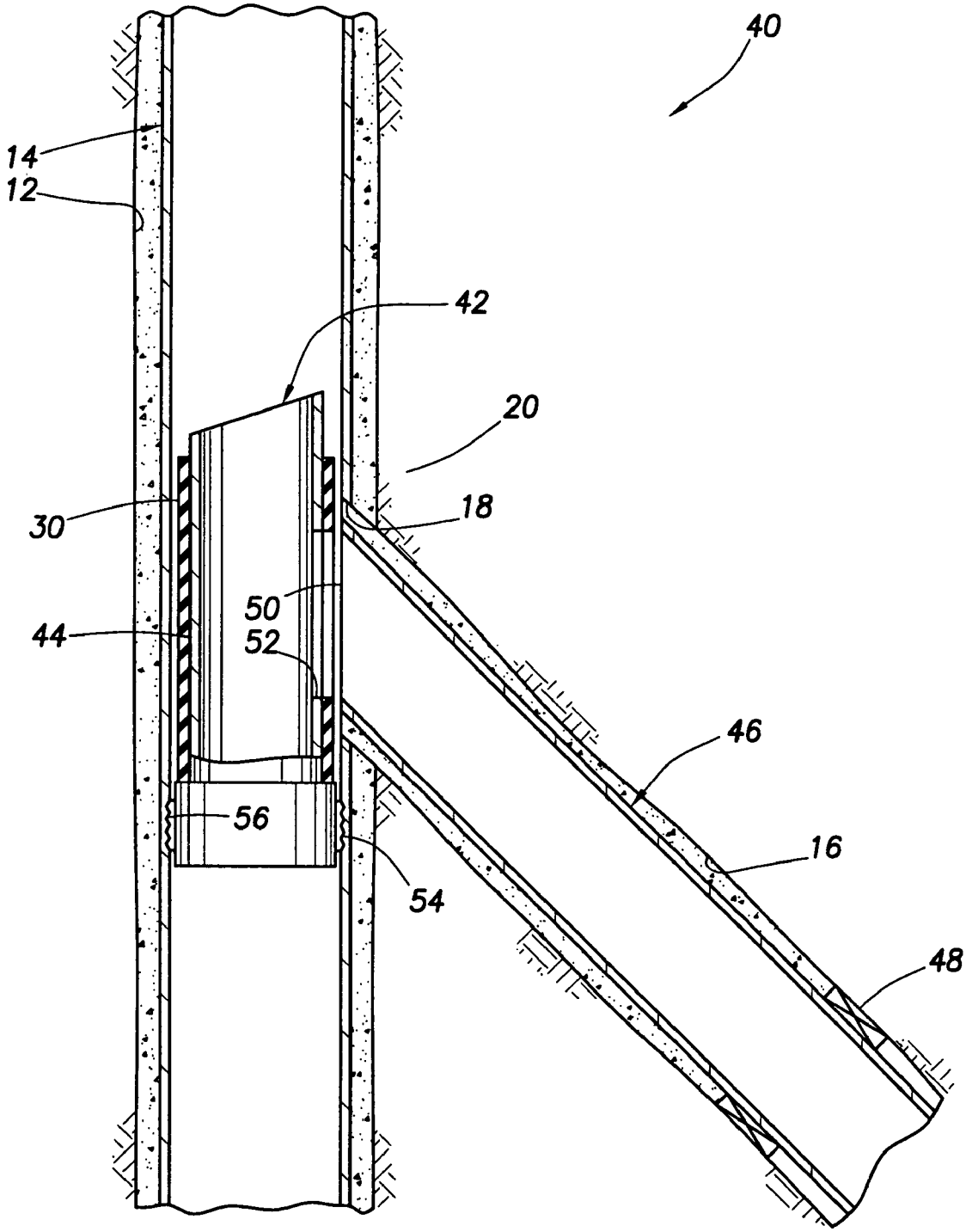
FIG. 3 is a schematic partially cross-sectional view of a second well completion system embodying principles of the present invention.

Referring additionally now to FIG. 3, another completion system 40 embodying principles of the invention is representatively illustrated. The system 40 is similar in many respects to the system 10 described above, and so elements of the system 40 which are similar to those described above are indicated in FIG. 3 using the same reference numbers.

The system 40 differs from the system 10 in at least one significant respect in that, instead of positioning the tubular string 24 in the parent and branch wellbores 12, 16, an assembly 42 is positioned in the parent wellbore opposite the window 18. The assembly 42 includes a tubular structure 44 having the sealing material 30 externally secured thereto. In addition, a tubular string 46, such as a liner string, is positioned in the branch wellbore 16.

The tubular string 46 is preferably positioned in the branch wellbore 16 prior to positioning the assembly 42 in the parent wellbore 12. The tubular string 46 may be cemented in the branch wellbore 16, for example, between the window 18 and a packer 48 set in the branch wellbore, or the tubular string may be otherwise cemented or left uncemented in the branch wellbore. An upper end 50 of the tubular string 46 may extend to the parent wellbore 12, where it may be cut off, such as by use of a washover tool, etc.

When the assembly 42 is positioned in the parent wellbore 12, it may have an opening 52 formed through its sidewall. This opening 52 may be rotationally aligned with the window 18 by engagement between a latch 54 of the assembly 42 and an orienting profile 56 of the casing string 14. This engagement may also anchor the assembly 42 in the casing string 14.

Alternatively, the opening 52 could be formed after the assembly 42 has been positioned in the parent wellbore 12. For example, a deflector (such as a whipstock) could be secured in the assembly 42 and used to deflect a cutting tool (such as a mill) to form the opening 52 through the assembly sidewall after the assembly is anchored in the casing string 14. Furthermore, the opening 52 could be formed through the sidewall of the assembly 42 after the sealing material 30 has swelled.

Figure 4:
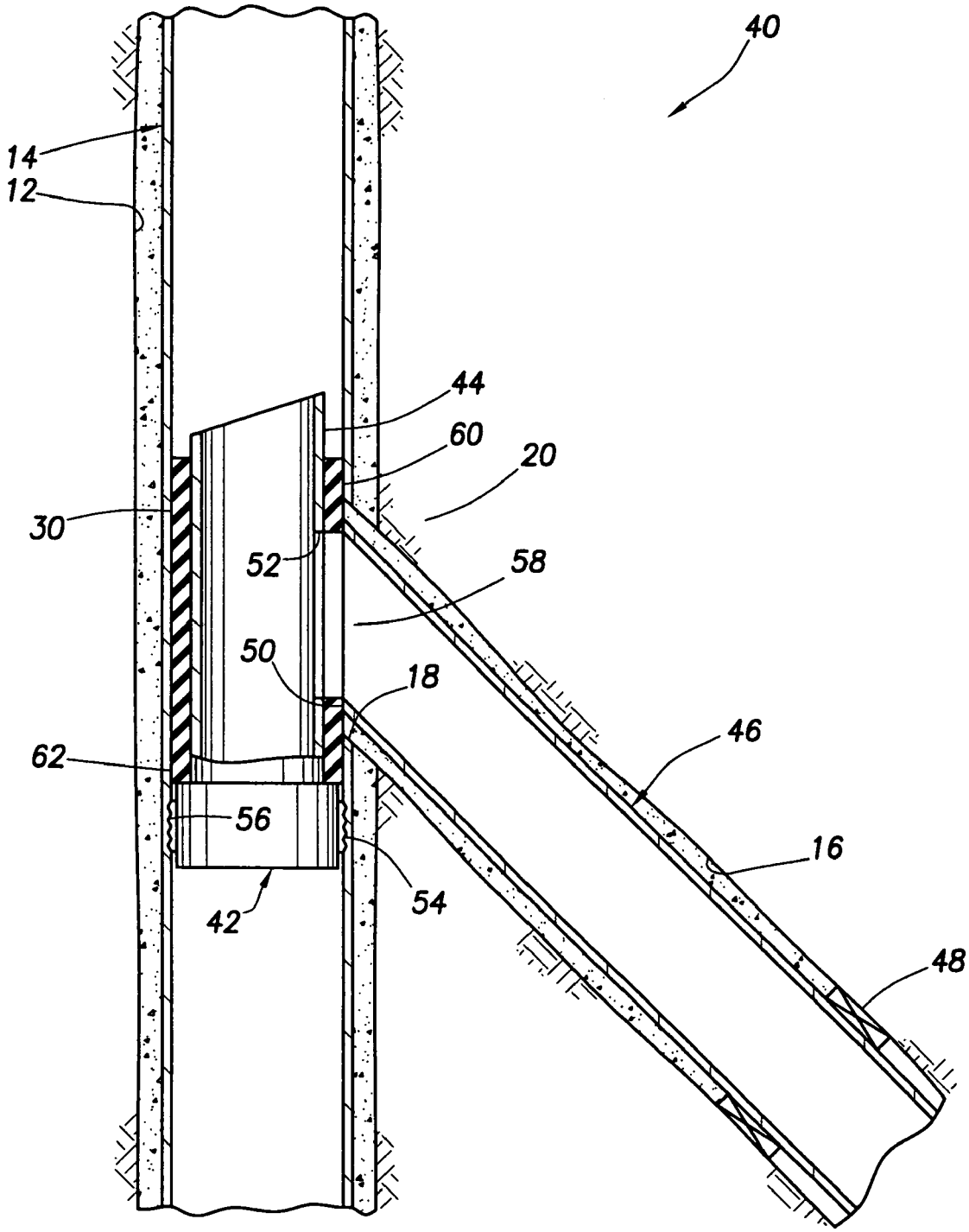
FIG. 4 is a schematic partially cross-sectional view of the second system, wherein an intersection between wellbores has been sealed.

Referring additionally now to FIG. 4, the system 40 is representatively illustrated after the sealing material 30 has swelled. The sealing material 30 may be swollen by exposure to fluid in the well, such as hydrocarbon fluid or water, etc. A volume of the sealing material 30 increases as it swells.

A sealed flowpath 58 is now provided between the branch wellbore 16 and the parent wellbore 12 through an interior of the assembly 42. This flowpath 58 is isolated from the formation 20 surrounding the intersection between the parent and branch wellbores 12, 16.

Specifically, the sealing material 30 now forms a seal 60 between the assembly 42 and the interior of the casing string 14 circumferentially about the opening 52 and circumferentially about the window 18. The sealing material 30 also preferably sealingly engages the upper end 50 of the tubular string 46 and seals circumferentially thereabout. In addition, the swollen sealing material 30 forms an annular seal 62 between the tubular structure 44 and the interior of the casing string 14 both above and below the window 18.

Of course, a person skilled in the art would, upon a careful consideration of the above description of a representative embodiment of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of completing a well having a branch wellbore extending outwardly from a window in a parent wellbore, the method comprising the steps of:

positioning an assembly in the window; and swelling a sealing material on the assembly by increasing a volume of the sealing material, so that a first seal is formed between the assembly and the window, wherein the assembly is a tubular string, and wherein the positioning step further comprises deflecting the tubular string from the parent wellbore into the branch wellbore.

2. The method according to claim 1, wherein the positioning step further comprises positioning the assembly at least partially in the parent wellbore and at least partially in the branch wellbore.

3. The method according to claim 1, further comprising the step of providing fluid communication between an interior of the tubular string and the parent wellbore via an opening formed through a sidewall of the tubular string.

4. The method according to claim 3, wherein the swelling step further comprises forming a second seal between the tubular string and the parent wellbore.

5. The method according to claim 4, wherein the swelling step further comprises forming the first and second seals on opposite sides of the opening.

6. The method according to claim 1, wherein in the swelling step, the sealing material is a rubber compound.

7. The method according to claim 1, wherein the swelling step further comprises swelling the sealing material in response to exposing the sealing material to water in the well.

8. A method of completing a well having a branch wellbore extending outwardly from a window in a parent wellbore, the method comprising the steps of:

positioning an assembly in the window; and swelling a sealing material on the assembly by increasing a volume of the sealing material, so that a first seal is formed between the assembly and the window, wherein the swelling step further comprises swelling the sealing material in response to exposing the sealing material to hydrocarbon fluid in the well.

9. A completion system for a well having a branch wellbore extending outwardly from a window in a parent wellbore, the system comprising:

a tubular string having a portion positioned within the window; and a sealing material on the tubular string portion, the sealing material being swellable in the well by increasing a volume of the sealing material, to thereby form a first seal between the tubular string portion and the window, wherein the tubular string extends into the branch wellbore below the window, and wherein the tubular string extends in the parent wellbore above the window.

10. The system according to claim 9, wherein the sealing material swells in response to exposure to water in the well.

11. The system according to claim 9, wherein the tubular string portion extends within the parent wellbore, the sealing material forming a second seal between the tubular string portion and the parent wellbore.

12. The system according to claim 9, wherein the tubular string portion has an opening formed through a sidewall thereof, the opening providing fluid communication between an interior of the tubular string and the parent wellbore.

13. The system according to claim 12, wherein the opening is positioned between the first seal and a second seal formed by the sealing material between the tubular string portion and the parent wellbore.

14. The system according to claim 9, wherein the sealing material is a rubber compound.

15. A completion system for a well having a branch wellbore extending outwardly from a window in a parent wellbore, the system comprising:

a tubular string having a portion positioned within the window; and a sealing material on the tubular string portion, the sealing material being swellable in the well by increasing a volume of the sealing material, to thereby form a first seal between the tubular string portion and the window, wherein the sealing material swells in response to exposure to hydrocarbon fluid in the well.

16. A completion system for a well having a branch wellbore extending outwardly from a window in a parent wellbore, the system comprising:

a tubular string having a portion positioned within the window; and a sealing material on the tubular string portion, the sealing material being swellable in the well by increasing a volume of the sealing material, to thereby form a first seal between the tubular string portion and the window, wherein the sealing material is a coating applied externally to the tubular string portion.

17. A method of completing a well having a branch wellbore extending outwardly from a window in a parent wellbore, the method comprising the steps of:

positioning an assembly in the parent wellbore;

forming an opening through a sidewall of the assembly;

aligning the assembly with the window; and swelling a sealing material on the assembly by increasing a volume of the sealing material, so that a first seal is formed about the opening, wherein the swelling step further comprises forming the first seal between the assembly and the parent wellbore circumferentially about the window.

18. The method according to claim 17, wherein the forming step is performed after the positioning step.

19. The method according to claim 17, wherein the aligning step further comprises aligning the opening with the window.

20. The method according to claim 17, wherein the swelling step further comprises forming the first seal between the assembly and circumferentially about an end of a tubular string positioned in the branch wellbore.

21. The method according to claim 17, further comprising the step of externally securing the sealing material on a tubular structure, and wherein the swelling step further comprises forming the first seal to provide a sealed flowpath between the branch wellbore and an interior of the tubular structure.

22. The method according to claim 21, wherein the swelling step further comprises forming a second seal between the tubular structure and the parent wellbore.

23. The method according to claim 22, wherein the second seal forming step further comprises forming the second seal above the window.

24. The method according to claim 22, wherein the second seal forming step further comprises forming the second seal below the window.

25. The method according to claim 17, wherein in the swelling step, the sealing material is a rubber compound.

26. The method according to claim 17, wherein the swelling step further comprises swelling the sealing material in response to exposing the sealing material to hydrocarbon fluid in the well.

27. The method according to claim 17, wherein the swelling step further comprises swelling the sealing material in response to exposing the sealing material to water in the well.

28. The method according to claim 17, wherein the aligning step further comprises engaging a latch of the assembly with an orienting latch profile.

29. A method of completing a well having a branch wellbore extending outwardly from a window in a parent wellbore, the method comprising the steps of:

positioning an assembly in the parent wellbore;

forming an opening through a sidewall of the assembly;

aligning the assembly with the window; and swelling a sealing material on the assembly by increasing a volume of the sealing material, so that a first seal is formed about the opening, wherein the forming step is performed before the positioning step.

30. A method of completing a well having a branch wellbore extending outwardly from a window in a parent wellbore, the method comprising the steps of:

positioning an assembly in the parent wellbore;

forming an opening through a sidewall of the assembly;

aligning the assembly with the window; and swelling a sealing material on the assembly by increasing a volume of the sealing material, so that a first seal is formed about the opening, wherein the forming step is performed after the swelling step.

31. A method of completing a well having a branch wellbore extending outwardly from a window in a parent wellbore, the method comprising the steps of:

positioning an assembly in the parent wellbore;

forming an opening through a sidewall of the assembly;

aligning the assembly with the window; and swelling a sealing material on the assembly by increasing a volume of the sealing material, so that a first seal is formed about the opening, wherein the forming step is performed before the swelling step.

32. A completion system for a well having a branch wellbore extending outwardly from a window in a parent wellbore, the system comprising:

an assembly positioned in the parent wellbore, the assembly having an opening formed through a sidewall thereof, the opening being aligned with the window; and a sealing material on the assembly, the sealing material being swellable in the well by increasing a volume of the sealing material, to thereby form a first seal circumferentially about the opening.

33. The system according to claim 32, wherein the sealing material swells in response to exposure to hydrocarbon fluid in the well.

34. The system according to claim 32, wherein the sealing material swells in response to exposure to water in the well.

35. The system according to claim 32, wherein the sealing material forms a second seal between the assembly and the parent wellbore.

36. The system according to claim 32, wherein the first seal is formed between the assembly and the parent wellbore circumferentially about the window.

37. The system according to claim 36, wherein the first seal is formed between the assembly and an end of a tubular string positioned in the branch wellbore.

38. The system according to claim 32, wherein the sealing material is a rubber compound.

39. The system according to claim 32, wherein the assembly includes a tubular structure, and wherein the first seal provides a sealed flowpath between the branch wellbore and an interior of the tubular structure.

40. The system according to claim 39, wherein the sealing material is a coating applied externally to the tubular structure.

* * * * *